US010344417B2

(12) United States Patent
Kim et al.

(10) Patent No.: US 10,344,417 B2
(45) Date of Patent: Jul. 9, 2019

(54) WASHING APPARATUS

(71) Applicant: LG ELECTRONICS INC., Seoul (KR)

(72) Inventors: Kyeonghwan Kim, Seoul (KR); Sungryong Kim, Seoul (KR); Jaehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 223 days.

(21) Appl. No.: 15/317,337

(22) PCT Filed: Dec. 8, 2014

(86) PCT No.: PCT/KR2014/012007
§ 371 (c)(1),
(2) Date: Dec. 8, 2016

(87) PCT Pub. No.: WO2015/190659
PCT Pub. Date: Dec. 17, 2015

(65) Prior Publication Data

US 2017/0130382 A1 May 11, 2017

(30) Foreign Application Priority Data

Jun. 9, 2014 (KR) ..... 10-2014-0069245
Jun. 9, 2014 (KR) ..... 10-2014-0069246

(51) Int. Cl.
*D06F 37/22* (2006.01)

(52) U.S. Cl.
CPC ..... *D06F 37/225* (2013.01)

(58) Field of Classification Search
CPC ..... D06F 37/225
See application file for complete search history.

(56) References Cited

U.S. PATENT DOCUMENTS 4,117,742 A 10/1978 Stein
5,813,253 A * 9/1998 Uhlin ..... D06F 37/225 210/144

(Continued)

FOREIGN PATENT DOCUMENTS

CN 201851629 U 6/2011
CN 202203363 U 4/2012

(Continued)

OTHER PUBLICATIONS

Machine Translation of CN 202203363 to Bian, Apr. 2012. (Year: 2012).*

*Primary Examiner* — Michael E Barr
*Assistant Examiner* — Benjamin L Osterhout
(74) *Attorney, Agent, or Firm* — Dentons US LLP

(57) ABSTRACT

A washing apparatus comprising a tub provided inside a cabinet; a drum provided inside the tub so as to be rotatable; a balancer housing installed on the front or rear side of the drum; and a balancing unit that includes a body, a drive motor, and a drive gear, the balancing unit movable in the balancer housing to reduce the eccentricity of the drum, wherein gear teeth are formed along an inner circumferential surface of the balancer housing, and the balancing unit is disposed in the balancer housing such that the drive gear is exposed to the outside of the body of the balancing unit to engage with the gear teeth.

15 Claims, 7 Drawing Sheets

(56) References Cited

U.S. PATENT DOCUMENTS

| | | | | |
|---|---|---|---|---|
| 2008/0105003 | A1* | 5/2008 | Ryu | D06F 37/225 68/13 R |
| 2010/0116003 | A1* | 5/2010 | Son | D06F 37/225 68/23.2 |
| 2011/0203325 | A1* | 8/2011 | Kim | D06F 37/225 68/140 |
| 2012/0151694 | A1* | 6/2012 | Jang | D06F 35/007 8/137 |
| 2012/0159717 | A1* | 6/2012 | Jang | D06F 35/006 8/137 |
| 2012/0192362 | A1 | 8/2012 | Lee et al. | |
| 2012/0222222 | A1* | 9/2012 | Chae | D06F 37/245 8/137 |
| 2012/0278996 | A1 | 11/2012 | Park et al. | |
| 2013/0024331 | A1* | 1/2013 | Pulley | G06Q 30/04 705/30 |
| 2013/0133475 | A1* | 5/2013 | Zelic | D06F 37/225 74/572.4 |
| 2013/0327098 | A1 | 12/2013 | Bae et al. | |
| 2013/0327099 | A1 | 12/2013 | Bae et al. | |

FOREIGN PATENT DOCUMENTS

| | | | |
|---|---|---|---|
| CN | 102899853 | A | 1/2013 |
| EP | 1045170 | A1 | 10/2000 |
| JP | 2005-054897 | A | 3/2005 |
| JP | 4248965 | B2 | 1/2009 |
| KR | 1020110010945 | A | 2/2011 |
| KR | 10-2013-0114482 | A | 10/2013 |
| KR | 10-2013-0137528 | A | 12/2013 |
| WO | 2013154313 | A1 | 10/2013 |

* cited by examiner

[Fig. 1]
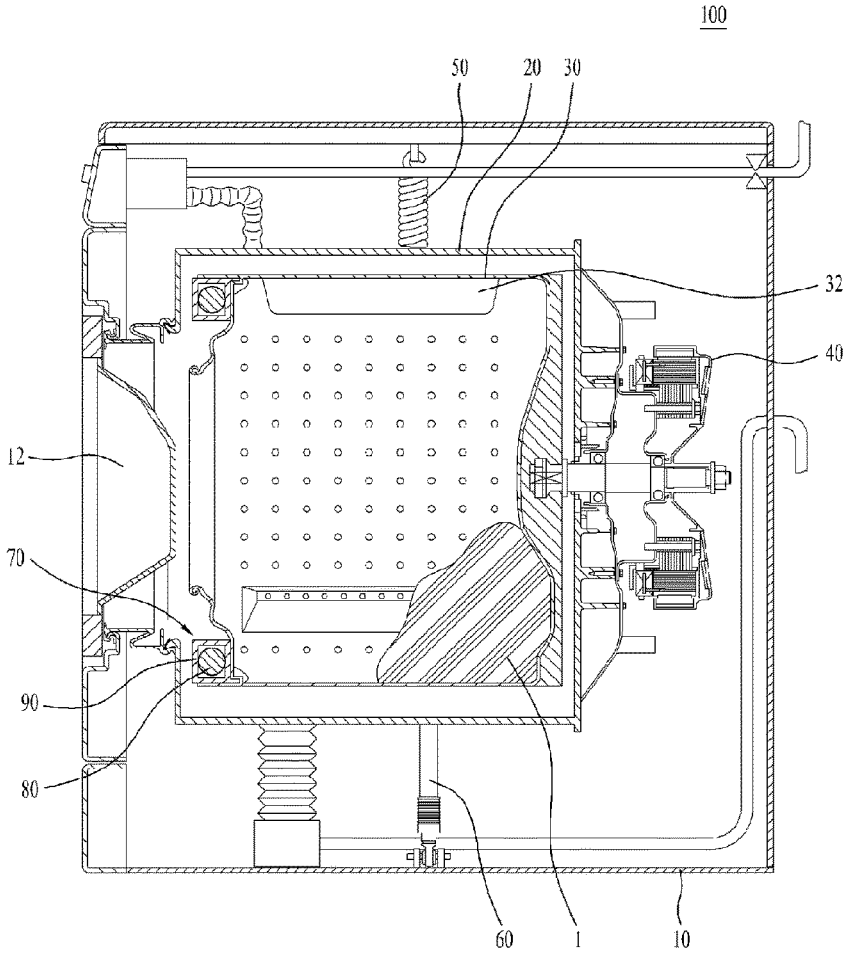
[Fig. 2]
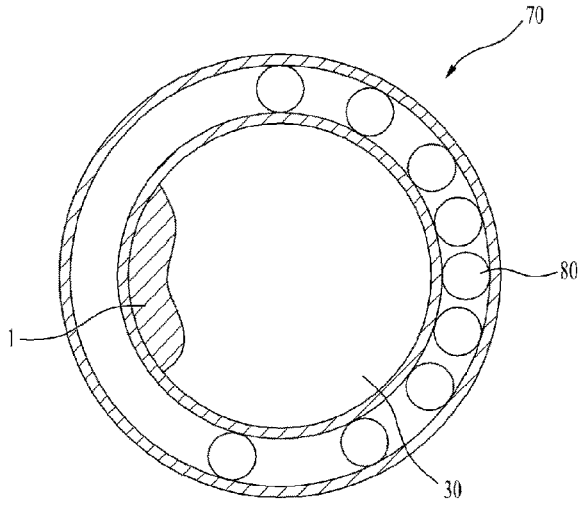

[Fig. 3]
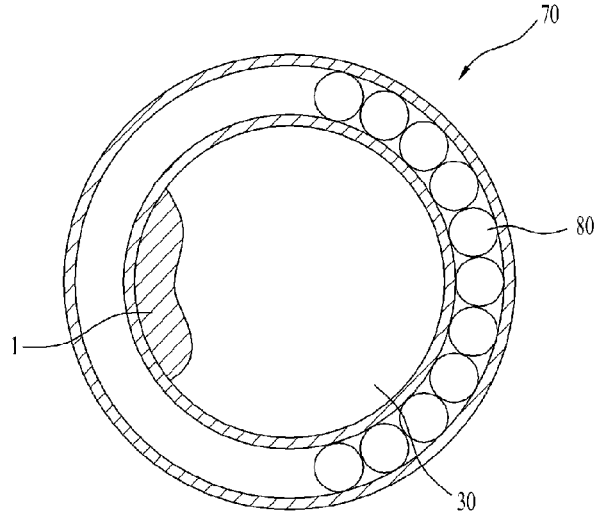
[Fig. 4]
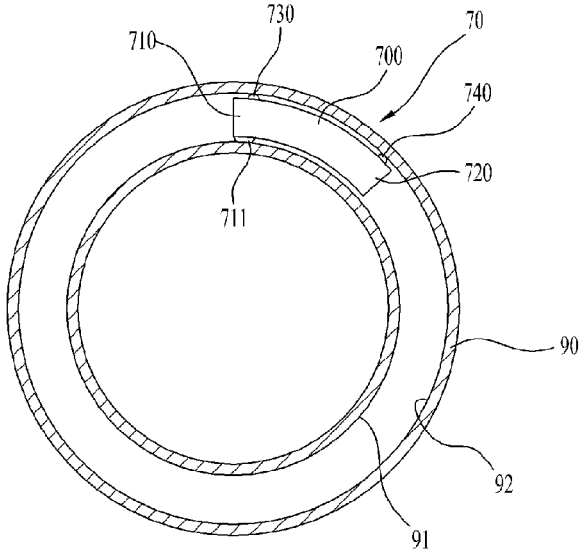

[Fig. 5]
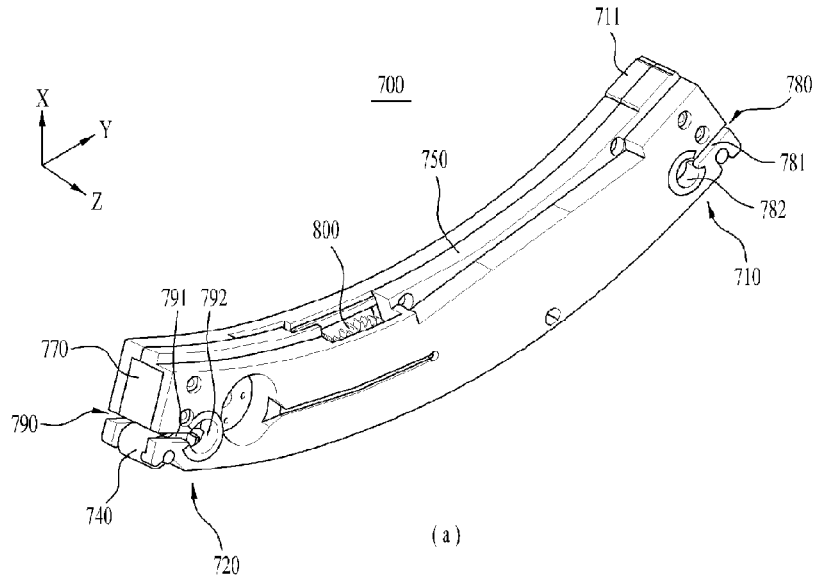
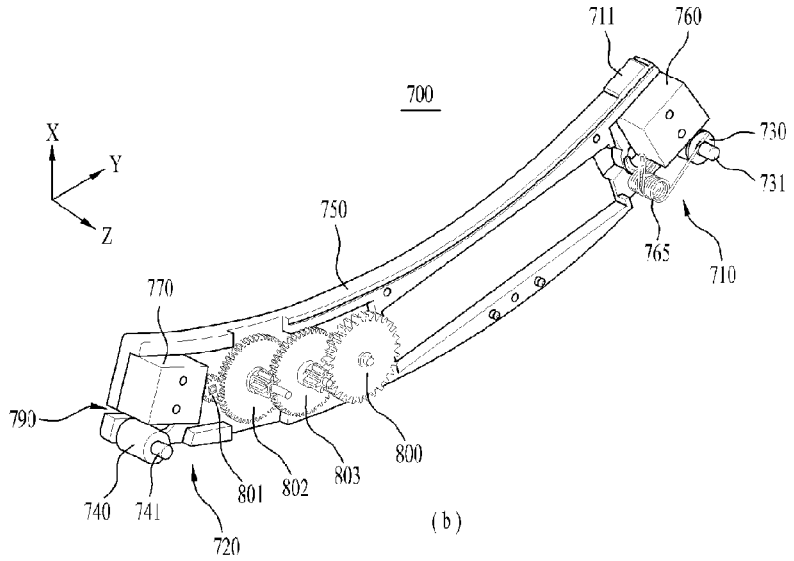

[Fig. 6]
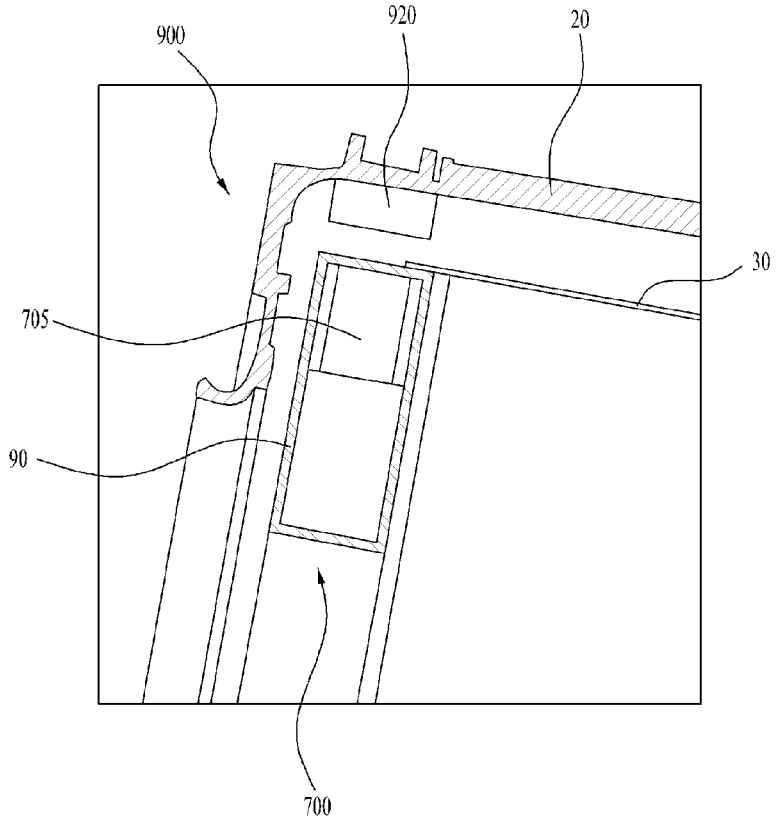
[Fig. 7]
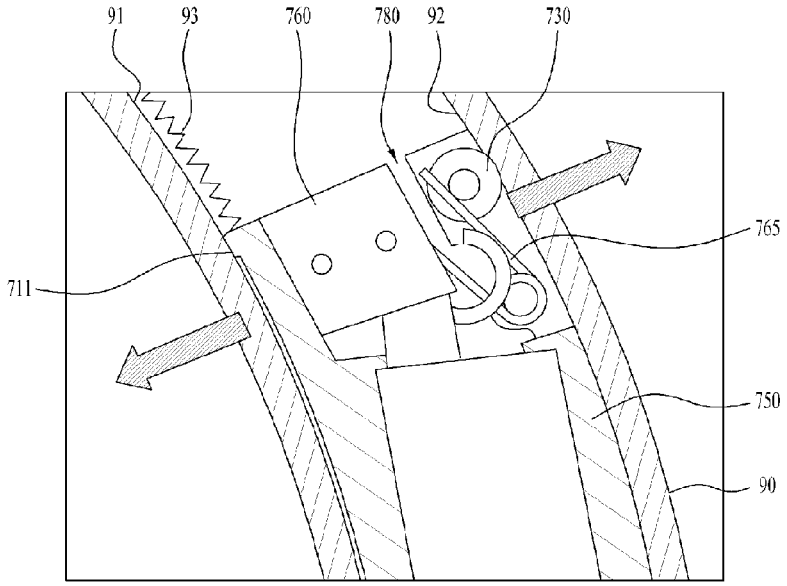

[Fig. 8]
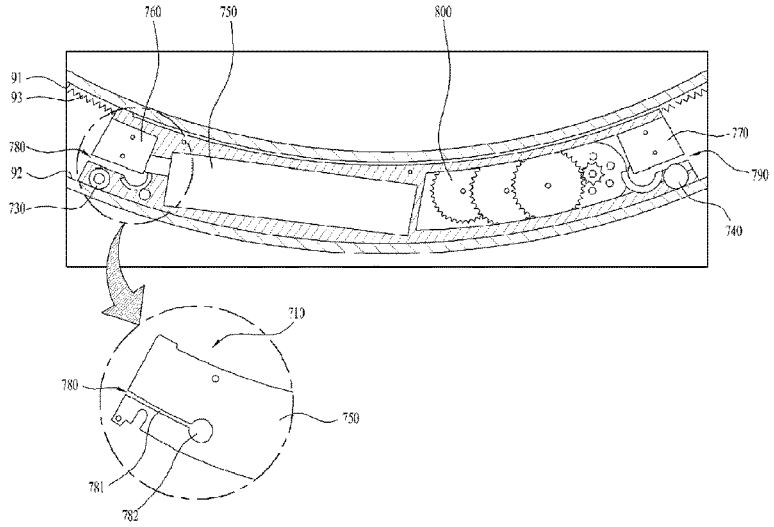
[Fig. 9]
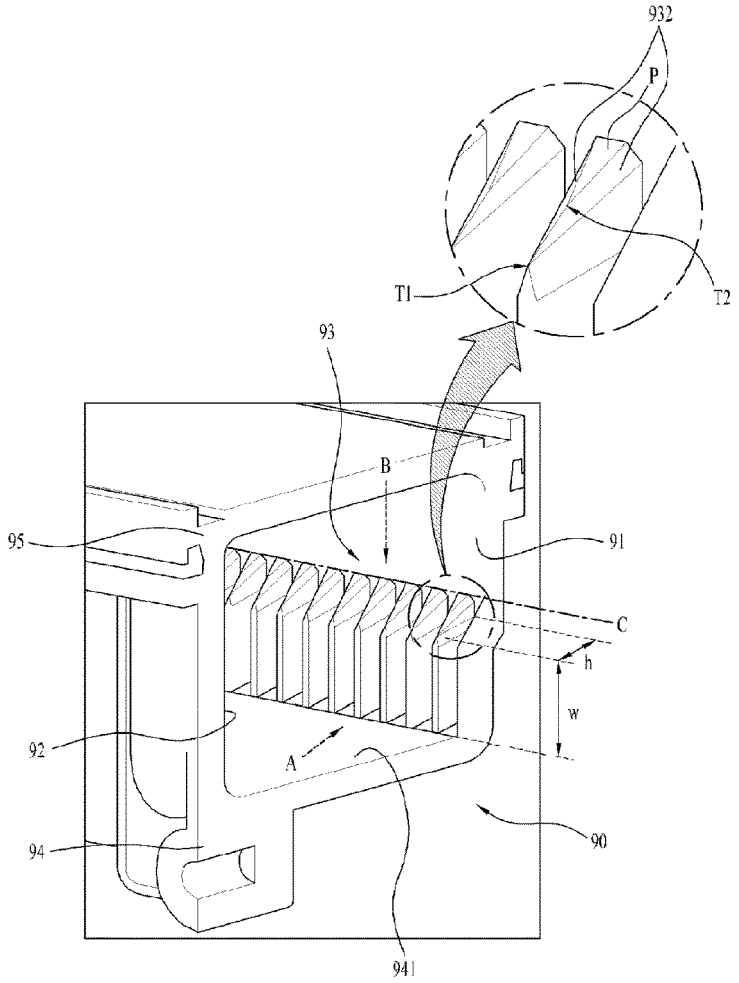

[Fig. 10]
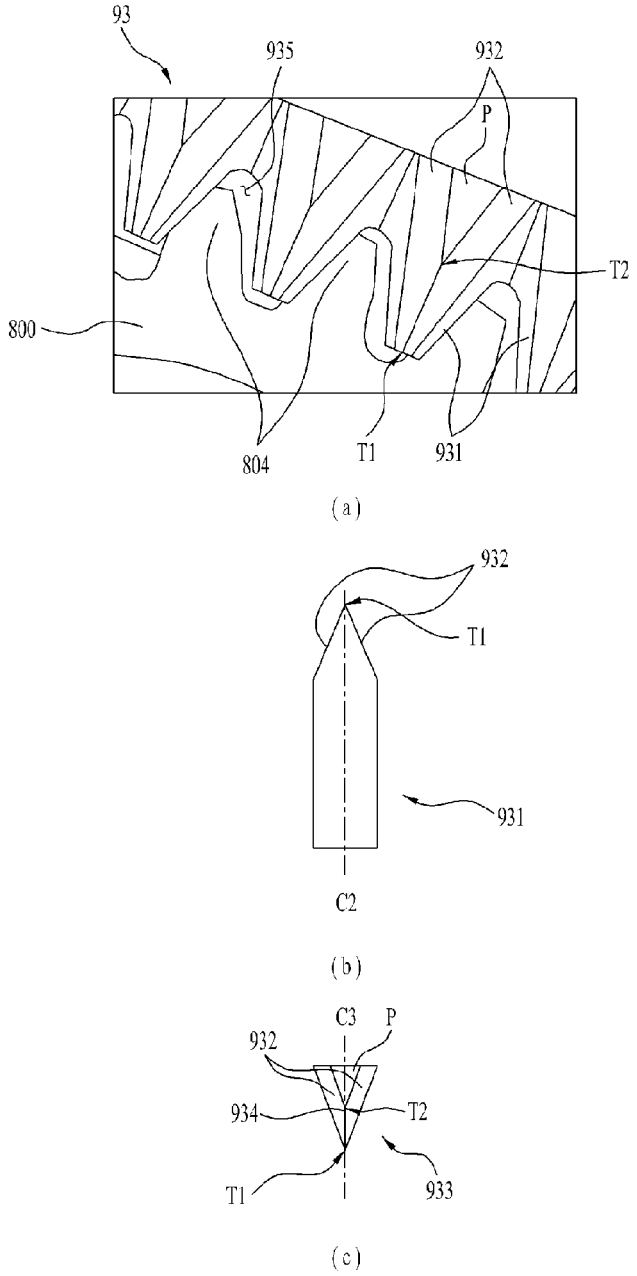

[Fig. 11]
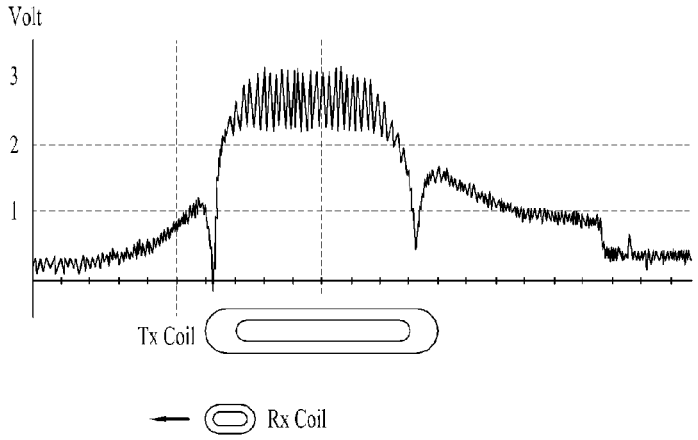

WASHING APPARATUS

This application is a National Stage Application of International Application No. PCT/KR2014/012007, filed on Dec. 8, 2014, which claims the benefit of Korean Patent Application No. 10-2014-0069245, filed on Jun. 9, 2014,and Korean Patent Application No. 10-2014-0069246, filed Jun. 9, 2014, all of which are hereby incorporated by reference in their entirety for all purpose as if fully set forth herein.

FIELD

Embodiments of the present disclosure relate to a washing apparatus, and more particularly, to a washing machine including a balancing unit configured to perform control actively.

BACKGROUND

A conventional washing apparatus is used in treating laundry or washing objects by rotating a drum in which laundry or washing objects are held. However, vibration and noise are generated in the conventional washing apparatus along with the rotation of the drum. Especially, such vibration and noise increase in a dry-spinning cycle in which the drum is rotated at a high rotation number.

To reduce the vibration and noise of the washing apparatus, balancing devices including a plurality of balls have been used and the balls are movable and arranged in an outer circumference of the drum.

However, the balls provided in the balancing device are passively moved along the rotation of the drum to balance the drum.

As the balls are passively moved along the rotation of the drum, it takes a relatively long time to balance the drum.

It also takes a relatively long time for the balls to move to balance the drum.

In addition, it could happen that the balls fail to be located in proper exact positions, respectively, when moving to balance the drum.

DETAILED DESCRIPTION

Technical Problem

To overcome the above-noted disadvantages, an object of the present disclosure is to provide a washing apparatus which may actively control movement of a balancing unit provided therein.

Another object of the present disclosure is to provide a washing apparatus which is capable of preventing or at least minimizing interference between a driving gear provided in a balancing unit and a gear provided in a balancer housing, when arranging the balancing unit in the balancer housing.

Technical Solution

To achieve these objects and other advantages and in accordance with the purpose of the embodiments, a washing apparatus comprises a tub provided in a cabinet; a drum rotatably provided in the tub; a balancer housing installed in a front or rear portion of the drum; and a balancing unit comprising a body, a driving motor, and a driving gear provided with electricity from the driving motor, the balancing unit being movable within the balancer housing to reduce eccentricity of the drum.

The balancing unit may include a body defining an exterior appearance of the balancing unit. A first mass may be provided in one width-direction portion of the body and the first wheel may be provided in the other width-direction portion of the body to roll on the inner circumferential surface of the balancer housing. In addition, a flexible member may be provided between the first mass and the first wheel. The flexible member pushes the first mass and the first wheel in the width-direction ends of the body.

A first support member for rotatably supporting the first wheel may be provided in the body of the balancing unit. At this time, both ends of the coil spring may be installed in the first mass and the first support member, respectively.

A projection may be projected toward the inner circumferential surface of the balancer housing from a lateral surface of the body in which the first mass is provided.

A first cut-away portion may be concavely formed in one longitudinal end of the body and recessed toward the other longitudinal end. The first mass may be provided in one width-direction side of the body and the first wheel may be provided in the other width-direction side of the body with respect to the first cut-away portion.

A second cut-away portion recessed to one longitudinal end may be formed in the other longitudinal end of the body. The second mass may be provided in one width-direction side and the second wheel may be provided in the other width-direction side of the body with respect to the second cut-away portion.

A second support member may be provided in the body to rotatably support the second wheel.

In this instance, the first cut-away portion may include a first slit extended from one longitudinal end of the body toward the other longitudinal end of the body, with a certain width; and a first flexible hole formed in one end of the first slit, with a larger width than the width of the first slit.

The second cut-away portion may also include a second slit extended toward one longitudinal end of the body, with a certain width; and a second flexible hole formed in one end of the second slit, with a larger width than the width of the second slit.

The balancing unit may further include a driving motor (not shown) provided in the second mass; a driving gear rotatable by using the power transmitted from the driving motor.

A plurality of gear teeth may be formed along the inner circumferential surface of the balancer housing and the driving gear may be configured to engage with the gear teeth 93 of the balancer housing.

The balancer housing may be provided along an inner or outer circumference of the front portion of the drum.

The first slit and the first flexible hole may penetrate the body of the balancing unit in a thickness direction.

The second slit and the second flexible hole may penetrate the body of the balancing unit in the thickness direction.

The balancing unit may further include one or more gears provided between the driving motor and the driving gear to transmit the electric power of the driving motor to the driving gear.

An opening may be formed in one portion of the body and the driving gear may be exposed outside the body via the opening.

One or more first coils may be provided in an outer circumference of the tub, corresponding to the balancer housing provided along an outer circumference of the drum. The balancing unit may include a second coil. When the balancing unit passes the portion where the first coil is arranged along with the rotation of the drum, the controller figure out the position of the balancing unit according to a difference between the voltages measured in the first coil.

At this time, the first coil is applied a predetermined voltage from an external power supply source. When the balancing unit passes the portion in which the first coil is arranged, electric currents flow in the second coil by the magnetic field of the first coil and the voltage applied to the first coil is higher than the preset voltage.

Alternatively, one or more first coil may be provided in the outer circumference of the tub, corresponding to the balancer housing provided along the outer circumference of the drum. The balancing unit may include a second coil. When the balancing unit actively moving within the balancer housing passes the portion where the first coil is arranged, the controller provided in the washing apparatus senses a difference between the voltages measured in the first coil and figure out the position of the balancing unit.

At this time, a predetermined voltage is applied to the first coil from an external power supply source. When the balancing unit passes the portion where the first coil is arranged, electric currents flow into the second coil by the electromagnetic induction and the voltage applied to the first coil may be higher than the predetermined voltage.

The flexible member is a coil spring and a first support member for rotatably supporting the first wheel may be provided in the body. Both ends of the coil spring are installed in the first mass and the first support member, respectively.

Embodiments of the present disclosure also provide a washing apparatus comprising a tub provided in a cabinet; a drum rotatably provided in the tub; a balancer housing installed in a front or rear portion of the drum; and a balancing unit comprising a driving motor and a driving gear provided with electricity from the driving motor, the balancing unit movable within the balancer housing to reduce eccentricity of the drum, wherein gear teeth are formed along an inner circumferential surface of the balancer housing, and the balancing unit is arranged in the balancer housing to engage the driving gear exposed outside a body of the balancing unit with the gear teeth.

One or more inclined portions may be formed in each of the gear teeth to prevent interference between the driving gear and the gear teeth when the balancing unit is arranged in the balancer housing.

The balancer housing may comprise a balancer housing base; and a balancer housing cover, and the inclined portions are formed in a width direction portion of the gear teeth toward the balancer housing cover.

The inclined portions may comprise a first inclined portion formed to make the gear teeth become narrower, as getting closer to the width-direction portion of the gear teeth toward the balancer housing cover.

A plane surface may be formed in a lateral surface of the gear teeth, and the inclined portions may further comprise a second inclined portion inclined from one end of the plane surface toward a front end of the gear teeth.

The first inclined portion may converge to a central line across the gear teeth in a width direction, as getting closer to the width-direction end of the gear teeth.

The first inclined portion may function as a guiding surface for guiding the driving gear of the balancing unit, when the balancing unit is arranged in the balancer housing.

The plane surface may have a preset slope toward the front end of the gear teeth, and the second inclined portion may have a larger slope toward the front end of the gear teeth than the slope of the plane surface.

The second inclined portion may function as a guide for guiding the driving gear of the balancing unit, when the balancing unit is arranged in the balancer housing.

The driving gear may be a pinion gear, and the plurality of the gear teeth are rack gears or ring gears.

The inner circumferential surface of the balancer housing may comprise a first inner circumferential surface and a second inner circumferential surface facing the first inner circumferential surface, and a diameter of the first inner circumferential surface may be smaller than a diameter of the second inner circumferential surface, and the gear teeth may be formed in at least predetermined portion of the first inner circumferential surface.

The gear teeth may be integrally formed with the inner circumferential surface of the balancer housing.

The gear teeth may be fabricated as independent elements from the balancer housing and installed in the inner circumferential surface of the balancer housing.

The plurality of the gear teeth may be provided and the first inclined portion is formed in each of the gear teeth.

The plane surface may be formed in a triangle shape, and the second inclined portion may be extended toward a tooth of the gear teeth from an apex of the plane surface toward the tooth of the gear teeth.

Advantageous Effects

The embodiments have following advantageous effects. The washing apparatus which may actively control movement of a balancing unit provided therein.

In a low speed rotation of the drum (0~150 RPM), the position of the balancing unit may be secured in the balancer housing in which the balancing unit is movable.

In a high speed rotation of the drum (600~800 RPM), the position of the balancing unit may be secured in the balancer housing in which the balancing unit is movable.

The washing apparatus which is capable of preventing or at least minimizing interference between a driving gear provided in a balancing unit and a gear provided in a balancer housing, when arranging the balancing unit in the balancer housing.

BRIEF DESCRIPTION OF THE DRAWINGS

FIG. 1 is a sectional diagram of a washing apparatus including a ball balancer in accordance with one embodiment of the present disclosure;

FIG. 2 is a schematic diagram illustrating a state where the ball balancer shown in FIG. 1 is not stabilized;

FIG. 3 is a schematic diagram illustrating a state where the ball balancer shown in FIG. 1 is stabilized;

FIG. 4 is a diagram schematically illustrating a balancer in accordance with another embodiment of the present disclosure;

FIG. 5(*a*) is a perspective diagram of the balancing unit shown in FIG. 4;

FIG. 5(*b*) is an exploded perspective diagram of the balancing unit shown in FIG. 4;

FIG. 6 is a diagram schematically illustrating a wireless charging device in accordance with one embodiment of the present disclosure;

FIG. 7 is a diagram illustrating that the balancing unit shown in FIG. 5 is arranged in a balancer housing provided in the balancing unit shown in FIG. 5, when the drum is rotated at a low rotation number;

FIG. 8 is a diagram illustrating that the balancing unit shown in FIG. 5 is arranged in the balancer housing provided in the drum, when the drum is rotated at a high rotation number;

FIG. 9 is a cut-away perspective diagram of the balancer housing provided in the drum;

FIG. 10(*a*) is a diagram illustrating a state where a driving gear has engaged with the gear teeth formed in an inner circumferential surface of the balancer housing;

FIGS. 10(*b*) and (*c*) are diagrams schematically illustrating that the gear teeth formed in the inner circumferential surface of the balancing housing shown in FIG. 9, seen in A direction and B direction; and FIG. 11 is a graph illustrating variation of the voltages measured in a coil provided in an outer circumference of a tub.

DESCRIPTION OF SPECIFIC EMBODIMENTS

Preferred embodiments of the present invention will be described below in more detail with reference to the accompanying drawings.

FIG. 1 is a sectional diagram of a washing apparatus including a ball balancer in accordance with one embodiment of the present disclosure.

Referring to FIG. 1, a washing apparatus 100 may include a cabinet 10 defining an exterior appearance of the washing apparatus, a tub 20 provided in cabinet 10 and holding wash water therein, a drum 30 rotatably provided in tub 20

Cabinet 10 defines the exterior design of washing apparatus 100 and the diverse components which will be described later are mounted in cabinet 10. First of all, a door 12 may be coupled to a front side of cabinet 10 and a user opens door 12 to introduce washing objects or laundry into cabinet 10. Specifically, the user may load the washing objects into the drum by opening door 12.

Tub 20 for holding wash water may be provided in cabinet 10. Drum 30 for holding the washing objects may be rotatable in tub 20. One or more lifters 32 may be provided in the drum to lift and drop the washing objects held in the drum, when the drum is rotated. It is preferred that three to five lifters 32 are provided in drum 30.

Meanwhile, a top and a bottom of tub 20 may be flexibly supported by a spring 50 and a damper 60 in cabinet 10, respectively. The vibration generated by the rotation of drum 30 is absorbed by spring 50 and damper 60, so that the vibration may not be transferred to cabinet 10. A driving unit 40 for rotating drum 30 may be mounted to a rear surface of tub 20. Driving unit 40 may comprise a motor and other elements and the drum may be rotated by the motor. Driving unit 40 is well-known to those skilled in the art to which the present disclosure pertains to and detailed description of the driving unit is omitted.

As illustrated in FIG. 1, when the drum is rotated with holding washing objects 1, it is possible to generate noise or vibration according to positions of washing objects 1. In other words, when drum 30 is rotated in a state where washing objects 1 are not uniformly distributed in the drum (hereinafter, eccentric rotation), a lot of vibration and noise could be generated in rotating drum 30 by the asymmetric distribution of washing objects 1. Accordingly, a balancer 70 may be provided in drum 30 to prevent such vibration and noise generated by the eccentric rotation of drum 30.

Balancer 70 may be provided in a front or rear portion of drum 30. For convenient description sake, it is shown in the drawing that balancer 70 is provided in the front portion of drum 30 but the embodiments of the present disclosure are not limited thereto.

Meanwhile, balancer 70 is provided in rotatable drum 30 and configured to prevent the noise and vibration. Accordingly, balancer 70 may be configured to have a variable center of gravity. In other words, balancer 70 may include a mass 80 having a predetermined weight and a passage for guiding mass 80 along a circumferential direction of drum 30. In case the load of washing objects 1 located in a certain portion of drum 30 is eccentric, the mass provided in balancer 70 is moving to the reverse portion of the eccentric distributed washing objects 1 only to prevent the noise and vibration generated by the eccentric rotation of drum 30.

In this instance, a liquid balancer having liquid with a predetermined weight or a ball balancer having a ball with a predetermined weight may be provided as balancer 70. In the illustrated embodiment of the washing apparatus, balancer 70 may include a ball 80 and filled fluid. Balancer 70 may further include a balancer housing 90 partitioning an internal space into a movement passage of ball 80 along an inner or outer circumference of drum 30. In other words, balancer housing 90 may be provided along the inner or outer circumference of the drum and ball 80 is able to move in balancer housing 90.

FIGS. 2 and 3 are diagrams illustrating the movement of ball 80 in balancer 70 during the rotation of the drum.

As shown in FIG. 2, when drum 30 is rotated, ball 80 arranged in balancer housing 90 of balancer 70 starts to slowly move to the reverse portion from where washing objects 1 are located in drum 30. Most of balls 80 having started to move are substantially located in the other side of washing objects 1 within a preset time period, as shown in FIG. 3. In other words, when washing objects 1 are gathered in a certain portion inside rotating drum 30, the eccentricity is generated in rotating drum 30 (that is, drum 30 is eccentrically rotated). At this time, balls 80 of balancer 70 are located in the reverse portion from where washing objects 1 are located, so as to compensate the amount of the eccentricity. For example, balls 80 are gathered in the reverse portion of the asymmetrically distributed washing objects once drum 30 is rotated at a high rotation speed, so that the eccentric rotation of drum 30 may be prevented and the noise and vibration generated by the eccentric rotation of drum 30 may be also prevented.

FIG. 4 is a diagram schematically illustrating a balancer in accordance with another embodiment of the present disclosure.

Referring to FIG. 4, balancer 70 in accordance with the illustrated embodiment may include a balancer housing 90 provided in an inner or outer circumference of drum 30; and a balancing unit 700 arranged in balancer housing 90. Balancing unit 700 shown in FIG. 4 is able to be movable within housing 90 and the movement of balancing unit 700 may be controlled actively.

In other words, the basic performance principle of balancing unit 700 is equal to that of balancing unit 70 shown in FIGS. 1 through 3, which controls balancing unit 70 to move to the reverse portion from where the washing objects are concentrated, when washing objects 1 are gathered in a specific portion inside drum 30, to prevent the noise and vibration which could be generated by the eccentric rotation of drum 30, except that balancing unit 700 is actively moved to a desired position in the embodiment shown in FIG. 4, compared with balancing unit 70 which is passively moved in balancer housing 90 according to the rotation of the drum. Such active control of balancing unit 700 may be implemented by a controller of the washing apparatus which is not shown and a driving motor and a driving gear which will be described later.

Balancer housing 90 has an inner circumferential surface and the inner circumferential surface of balancer housing 90 consists of a first inner circumferential surface 91 and a second inner circumferential surface 92 facing first inner circumferential surface 91. A diameter of first inner circumferential surface 91 is smaller than a diameter of second inner circumferential surface 92, so that a certain space in which balancing unit 700 is movable may be defined between first inner circumferential surface 91 and second inner circumferential surface 92 within balancer housing 90.

Balancing unit 700 may have a predetermined length. Wheels 730 and 740 configured to roll on the inner circumferential surface (for example, the first inner circumferential surface) of balancer housing 90 may be provided in both longitudinal ends 710 and 720 of balancing unit 700, respectively. A stopper 711 may be projected from one longitudinal end 710 of balancing unit 700 toward the inner circumferential surface (for example, the second inner circumferential surface). Stopper 711 is configured to stop balancing unit 700 in a preset position within balancer housing 90. Next, referring to FIGS. 5 through 7, the balancing unit in accordance with the embodiment illustrated in FIG. 4 will be described in detail.

FIG. 5(*a*) is a perspective diagram of the balancing unit shown in FIG. 4 and FIG. 5(*b*) is an exploded perspective diagram of the balancing unit shown in FIG. 4. To make it easy to understand the description, X-axis, Y-axis, and Z-axis shown in the drawings are defined as a width direction, a longitudinal direction, and a thickness direction of the balancing unit (that is, a body of the balancing unit).

Referring to FIGS. 5(*a*) and (*b*), balancing unit 700 in accordance with the illustrated embodiment includes a body 750 defining an exterior appearance of balancing unit 700. Body 750 has a certain length and a gently curved shape to be arranged in balancer housing 90 provided along the circumference (the inner or outer circumference) of drum 30. Specifically, balancer housing 90 provided along the circumference of drum 30 may have a radius of curvature which is equal to a radius of curvature of the drum circumference. Accordingly, to arrange body 750 of balancing unit 700 in balancer housing 90, body 750 may be also gently curved at a certain radius of curvature. For example, body 750 may have a larger radius of the curvature than the radius of the curvature of balancer housing 90. In other words, body 750 may be more gently curved than balancer housing 90.

A first mass 760 may be provided in one width-direction portion of body 750 and first wheel 730 may be provided in the other width-direction portion of body 750 to roll on the inner circumferential surface of balancer housing 90. In addition, a flexible member 765 may be provided between first mass 760 and first wheel 730. Flexible member 765 pushes first mass 760 and first wheel 730 in the width-direction ends of body 750, to secure body 750 of balancing unit 700 in a predetermined position within balancer housing 90. For example, flexible member 765 may be a coil spring and both ends of the coil spring may be installed between first mass 760 and first wheel 730 to push first mass 760 and first wheel 730 to the width-direction ends of body 750.

A first support member 731 for rotatably supporting first wheel 730 may be provided in body 750 of balancing unit 700. At this time, both ends of the coil spring may be installed in first mass 760 and first support member 731, respectively. A projection 711 may be projected toward the inner circumferential surface (that is, the first or second inner circumferential surface) of balancer housing 90 from a lateral surface of body 750 in which first mass 760 is provided. For example, projection 711 may be formed in an upper width-direction portion of body 750 as shown in FIG. 5. Projection 711 may serve as a stopper for fixing balancing unit 700 in a certain position within balancer housing 90. Specifically, when the coil spring pushes first mass 760 and first wheel 730 to the width-direction ends of body 750, projection 711 formed near first mass 760 may contact with the inner circumferential surface (that is, the first inner circumferential surface) of balancer housing 90 and the position of balancing unit 700 can be secured.

Meanwhile, a first cut-away portion 780 may be concavely formed in one longitudinal end 710 of body 750 and recessed toward the other longitudinal end 720. At this time, first mass 760 may be provided in one width-direction side of body 750 and first wheel 730 may be provided in the other width-direction side of the body with respect to the first cut-away portion 780. For example, first mass 760 may be provided in a width-direction upper portion and first wheel 730 may be provided in a lower width-direction portion of body 750 with respect to the first cut-away portion 780. The flexible member (that is, the coil spring) is arranged between first mass 760 and first wheel 730 to push them to the width-direction ends of body 750, so that projection 711 formed in body 750 can secure the position of balancing unit 700, in contact with the inner circumferential surface (that is, the first inner circumferential surface) of balancer housing 90.

A second cut-away portion 790 recessed to one longitudinal end 710 may be formed in the other longitudinal end 720 of body 750. At this time, second mass 770 may be provided in one width-direction side and second wheel 740 may be provided in the other width-direction side of body 750 with respect to second cut-away portion 790. A second support member 741 may be provided in body 750 to rotatably support second wheel 740.

In this instance, first cut-away portion 780 may include a first slit 781 extended from one longitudinal end 710 of body 750 toward the other longitudinal end 720 of body 750, with a certain width; and a first flexible hole 782 formed in one end of first slit 781, with a larger width than the width of first slit 781. Second cut-away portion 790 may also include a second slit 791 extended toward one longitudinal end 710 of body 750, with a certain width; and a second flexible hole 792 formed in one end of second slit 791, with a larger width than the width of second slit 791. At this time, first slit 781, first flexible hole 782, second slit 791, and second flexible hole 792 may penetrate body 750 of balancing unit 700 along a thickness direction.

As first slit 781 and second slit 782 are formed in both ends of body 750, respectively, the widths of the ends of body 750 may be reduced as much as the widths of first slit 781 and second slit 782. In case the ends of body 750 are reduced as much as first slit 781 and second slit 782 in the width, the radius of the curvature of body 750 may be equal to the radius of the curvature of balancer housing 90 and one lateral surface of body 750 may surface-contact with the inner circumferential surface (that is, the second inner circumferential surface) of balancer housing 90.

Balancing unit 700 may further include a driving motor (not shown) provided in second mass 770; a driving gear 800 rotatable by using the power transmitted from the driving motor. A plurality of gear teeth 93 may be formed along the inner circumferential surface of balancer housing 90 (see FIGS. 6 through 9) and driving gear 800 may be configured to engage with gear teeth 93 of balancer housing 90. At least one predetermined portion of driving gear 800 may be exposed outside body 750 via an opening 751 formed in body 750, to engage driving gear 800 mounted in body 750 of balancing unit 700 with gear teeth 93 formed in the balancer housing. Specifically, opening 751 is formed in a certain portion of body 750 and driving gear 800 is partially exposed via opening 751 so as to engage with gear teeth 93 formed in balancer housing 90. When the driving power of the driving motor is transferred to driving gear 800, driving gear 800 is rotated while engaging with gear teeth 93 of balancer housing 90, such that balancing unit 700 is able to move within balancer housing 90.

Meanwhile, balancing unit 700 may further include one or more gears arranged between the driving motor and driving gear 800 to transmit the driving force of the driving motor to driving gear 800. In the illustrated embodiment, a first gear 801, a second gear 802, and a third gear 803 may be arranged between the driving motor and driving gear 800. While the rotation of the driving motor is decelerated according to a gear ratio of the first to third gears arranged between the driving motor and driving gear 800, the rotation torque transferred to driving gear 800 may rise. In contrast, while the rotation of the driving motor is accelerated according to the gear ratio of the first to third gears, the rotation torque transferred to driving gear 800 may become lower.

Although not shown in the drawings, balancing unit 700 may include a power supply source such as a battery to supply the electric power to the driving motor. In case of using the battery as the power supply source, the structure of balancing unit 700 is likely to become complex. If the battery discharges electricity, the user has to dissemble balancing unit 700 and replace the battery inconveniently. Hereinafter, a wireless charging device capable of charging the balancing unit wirelessly will be described referring to the accompanying drawing.

FIG. 6 is a diagram schematically illustrating a wireless charging device in accordance with one embodiment of the present disclosure.

Referring to FIG. 6, wireless charging device 900 may include a magnet 920 provided in a predetermined portion of tub 20; and a solenoid 705 provided in balancing unit 700, corresponding to magnet 920. When balancing unit 700 is rotated, a capacitor (not shown) of balancing unit 700 is charged via solenoid 705 by electromagnetic induction between solenoid 705 and magnet 920 provided in tub 20. Magnet 920 is provided in tub 20 and is not rotatable. The capacitor can be charged by rotation of drum 30 or balancing unit 700. For the rotation of balancing unit 700, balancing unit 700 may be fixed to a certain portion along balancer housing 90 and drum 30 is rotated so that balancing unit 700 can be rotated together with drum 30.

Although not shown in the drawing, the magnet and solenoid mentioned above may be replaced as a first coil and a second coil. In other words, when balancing unit 700 is rotated, balancing unit 700 may be charged by the electromagnetic induction between the first and second coils. This example is similar to the illustrated embodiment shown in FIG. 6, except that the first and second coils replace the magnet and solenoid of the wireless charging device. Accordingly, detailed description thereof is omitted.

As mentioned above, the driving motor is provided with electricity by the battery (not shown) or the capacitor and the movement of balancing unit 700 may be controlled by communication between a signal receiving unit (not shown) installed in balancing unit 700 and the controller provided in the washing apparatus. For example, when sensing the eccentric rotation of drum 30, the controller may move balancing unit 700 in a direction for reducing the eccentric rotation of drum 30. In other words, the controller rotates the driving motor to move balancing unit 700 to a desired position within balancer housing 90. At this time, the desired position means the position for reducing the eccentric rotation of drum 30 (that is, the reverse portion from where the washing objects are concentrated as shown in FIG. 3).

FIG. 7 is a diagram illustrating that the balancing unit shown in FIG. 5 is arranged in a balancer housing provided in the balancing unit shown in FIG. 5, when the drum is rotated at a low rotation number (for example, 0~150 RPM).

A predetermined rotation speed section of drum 30 in which balancing unit 700 is secured within balancer housing 90, not sliding, even once drum 30 starts to rotate may be referred to as "a low speed rotation section (for example, 0~150 RPM)". A predetermined rotation speed section of drum 30 in which balancing unit 700 is movable within balancer housing 90 while the drum is rotated may be referred to as "an operable rotation section (for example, 150~400 RPM)". A rotation speed section of drum 30 in which balancing unit 700 is secured within balancer housing 90, not sliding. When drum 30 is rotated at a predetermined speed or more may be referred to as "a high speed rotation section (for example, 700 RPM or more). The operable rotation section may be defined as the mid-speed rotation section. It is preferred that balancing unit 700 is secured in a preset position within balancer housing 90 in the low speed rotation section and the high speed rotation section of drum 30. It is preferred that balancing unit 700 is movable within balancer housing 90 in the operable rotation section (the mid-speed rotation section).

Referring to FIG. 7, when drum 30 is rotated at a low speed (that is, in the low speed rotation section), balancing unit 700 has to be secured in the preset position within balancer housing 90 not to move within balancer housing 90. To secure balancing unit 700 in the preset position within balancer housing 90, projection 711 may be projected from body 750 of balancing unit 700 toward first inner circumferential surface 91 of balancer housing 90. For example, projection 711 may be formed in a left width-direction portion of body 750 as shown in FIG. 7. Such projection 711 may serve as the stopper for fixing balancing unit 700 in the preset position within balancer housing 90.

Specifically, when flexible member (that is, the coil spring) 765 pushes first mass 760 and first wheel 730 to the width-direction ends of body 750 (in a direction of an arrow shown in FIG. 7) with respect to first cut-away portion 780, projection 711 serving as the stopper may contact with first inner circumferential surface 91 of balancer housing 90 and the position of balancing unit 700 can be secured. In other words, in the low speed rotation section of drum 30, the elasticity of flexible member 765 pushing first mass 760 and first wheel 730 to the width-direction ends of body 750 is stronger than the centrifugal force provided to balancing unit 700 by the rotation of drum 30. Accordingly, balancing unit 700 may be secured in the preset position within balancer housing 90 in the low speed rotation section of drum 30.

Meanwhile, in the operable rotation section in which drum 30 is rotated at a preset rotation speed (approximately 150~400 RPM), balancing unit 700 is movable within balancer housing 90. In other words, the centrifugal force applied to balancing unit 700 by the rotation of the drum is stronger than the elastic force of flexible member 765 pushing first mass 760 and first wheel 730 to the width-direction ends of body 750 in the operable rotation section. Accordingly, in the operable rotation section of drum 30, projection 711 serving as the stopper may be separated from first inner circumferential surface 91 of balancer housing 90 and balancing unit 700 is movable within balancer housing 90. In other words, first wheel 730 is provided opposite to projection 711 in body 750 of balancing unit 700. When projection 711 functioning as the stopper is separated from first inner circumferential surface 91 of balancer housing 90, first wheel 730 rolls on second inner circumferential surface 92 of balancer housing 90 to move balancing unit 700.

Of course, the movement of balancing unit 700 may be generated once the driving force of the driving motor is transferred to driving gear 800 according to a command of the controller (not shown). In other words, if vibration and noise are likely to occur because of the eccentric rotation of drum 30, the controller may control balancing unit 700 to move to the preset position within balancer housing 90 in which the eccentric rotation is reduced or removed. Specifically, when vibration and noise are generated by the eccentric rotation of the drum rotated at a preset speed, the controller may compensate the amount of the eccentricity by moving balancing unit 700 so as to remove the vibration and noise. At this time, the controller may control the rotation speed and rotation direction of the driving motor within balancing unit 700. Balancing unit 700 may be moved within balancer housing 90 according to the driving of the driving motor.

FIG. 8 is a diagram illustrating that the balancing unit shown in FIG. 5 is arranged in the balancer housing provided in the drum, when the drum is rotated at a high rotation number (for example, at 700 RPM or more).

In the high speed rotation section of drum 30, balancing unit 700 has to be secured in the preset position within balancer housing 90. However, balancing unit 700 is likely to be slidingly moved within balancer housing 90 by the rotational force of drum 30 rotated at a high speed.

Referring to FIG. 8, body 750 of balancing unit 700 may be gently curved at a certain radius of curvature to arrange balancing unit 700 in balancer housing 90 having a certain curvature. Specifically, body 750 may have a larger radius of the curvature than balancer housing 90. Body 750 may be more gently curved than balancer housing 90.

Meanwhile, when drum 30 is rotated at a high speed, projection 711 functioning as the stopper of balancing unit 700 is separated from first inner circumferential surface 91 of balancer housing 90 not to function as the stopper. However, when balancing unit 700 located in balancer housing 90 is provided with the centrifugal force by the high speed rotation of drum 30, the width of body 750 may be reduced with respect to first cut-away portion 780 and second cut-away portion 790 of balancing unit 700. Specifically, first cut-away portion 780 and second cut-away portion 790 are formed in the longitudinal ends of balancing unit 700, respectively. Accordingly, when drum 30 is rotated at a high speed, the widths of the ends of balancing unit 700 are reduced with respect to first cut-away portion 780 and second cut-away portion 790.

The centrifugal force applied to balancing unit 700 by the high speed rotation of drum 30 may be stronger than the elastic force of flexible member 765 pushing first mass 760 and first wheel 730 to the width-direction ends of body 750. Body 750 of balancing unit 700 is also made of a material having certain elasticity and the centrifugal force applied to balancing unit 700 by the high speed rotation of drum 30 is stronger than the elastic force of body 750, so that the width of body 750 with respect to the first and second cut-away portions 780 and 790 may be reduced as much as the widths of the first and second cut-away portions 780 and 790.

Hence, when the widths of the longitudinal ends of body 750 are reduced with respect to the first and second cut-away portions 780 and 790, body 750 of balancing unit 700 is deformed. In other words, when the widths of the longitudinal ends of body 750 are reduced, the radius of the curvature of body 750 is reduced. For example, body 750 of balancing unit 700 provided with the centrifugal force generated by the high speed rotation of drum 30 is deformed to be more gently curved than before provided with the centrifugal force. At this time, the radius of the curvature of body 750 provided in balancing unit 700 may be equal to the radius of the curvature of balancer housing 90.

When drum 30 is rotated at a high speed, a lateral surface of the body provided in balancing unit 700 toward second inner circumferential surface 92 of balancer housing 90 surface-contacts with second inner circumferential surface 92 of balancer housing 90. At this time, the lateral surface of body 750 arranged toward second inner circumferential surface 92 of balancer housing 90 may function as the stopper only to secure balancing unit 700 in the preset position within balancer housing 90.

The high speed rotation of drum 30 decreases the widths of the longitudinal ends of body 750 provided in balancing unit 700 and the radius of the curvature of body 750 becomes equal to the radius of the curvature of balancer housing 90. The centrifugal force generated by the high speed rotation of drum 30 enables the surface of body 750 (in other words, the lateral surface of body 750 toward second inner circumferential surface 92 of balancer housing 90) to surface-contact with second inner circumferential surface 92 of balancer housing 90, only to secure balancing unit 700 in the preset position within balancer housing 90.

FIG. 9 is a cut-away perspective diagram of the balancer housing provided in the drum. FIG. 10(*a*) is a diagram illustrating a state where a driving gear has engaged with the gear teeth formed in an inner circumferential surface of the balancer housing. FIGS. 10(*b*) and (*c*) are diagrams schematically illustrating that the gear teeth formed in the inner circumferential surface of the balancing housing shown in FIG. 9, seen in A direction and B direction.

Hereinafter, referring to FIGS. 9 and 10(*a*), (*b*), and (*c*) will be described driving gear 800 of balancing unit 700 which engages with gear teeth 93 formed in the inner circumferential surface of balancer housing 90, when balancing unit 700 is arranged in balancer housing 90. At this time, driving gear 800 may be formed as a pinion gear and the plurality of gear teeth 93 formed in the inner circumferential surface of balancer housing 90 may be formed as a rack gear or ring gear.

Balancing housing 90 provided in a front portion of drum 30 to accommodate balancing unit 700 may include a balancer housing base 94 and a balancer housing cover 95 which are detachably coupled to each other. In other words, balancer housing base 94 and balancer housing cover 95 are coupled to each other to form balancer housing 90.

In balancer housing base 94 may be formed a first inner circumferential surface 91 of balancer housing 90 and a second inner circumferential surface 92 facing first inner circumferential surface 92. Gear teeth 93 may be formed in at least predetermined portion of first inner circumferential surface 91. For example, first inner circumferential surface 91 may be divided into one portion and the other portion with respect to a circumference-direction central line (C1) and gear teeth 93 may be formed in one portion of inner circumferential surface 91 (a lower portion of the central line (C1), see FIG. 9).

At this time, gear teeth 93 may be integrally formed with first inner circumferential surface 91 or formed as independent elements and installed in first inner circumferential surface 91. A rack gear or ring gear fabricated as gear teeth 93 may be installed along first inner circumferential surface 91 of balancer housing base 94.

To arrange balancing unit 700 in balancer housing 90, balancer housing cover 95 has to be detached from balancer housing base 94. In other words, balancer housing cover 95 is decoupled from balancer housing base 94 and then balancing unit 700 can be installed in balancer housing base 94 in B-direction shown in FIG. 9. After balancing unit 700 is installed in balancer housing base 74, balancer housing cover 95 is covered to accommodate balancing unit 700 in balancer housing 90.

Meanwhile, at least a predetermined portion of driving gear 800 provided in balancing unit 700 may be exposed outside body 750 of balancing unit 700 to engage with gear teeth 93 formed in balancer housing 90. When installing balancing unit 700 in balancer housing base 94, there could be interference between a lateral surface of driving gear 800 and a lateral surface of gear teeth 93. Accordingly, an inclined portion 932 and 934 inclined a preset angle may be formed in gear teeth 93 provided in balancer housing 90, to facilitate the installation of balancing unit 700 in balancer housing base 94. Next, inclined portions 932 and 934 will be described in detail.

To help the present disclosure to be understood, the portion of gear teeth 93 seen in A-direction shown in FIG. 9 may be defined as "a front end portion 931 of gear teeth 93" and the portion of gear teeth 93 seen in B-direction shown in FIG. 9 may be defined as "a lateral portion 933 of gear teeth 93". A projected direction of gear teeth 93 from first inner circumferential surface 91 of balancer housing 90 may be defined as "a height direction (h) of gear teeth 93" and a projected direction of gear teeth 93 toward balancer housing cover 95 from balancer housing base 94 may be defined as "a width direction (w) of gear teeth 93". Front end portion 931 of gear teeth 93 may be perpendicular to lateral portion 933 of gear teeth 93.

Font end portion 931 of gear teeth 93 may engage with driving gear 800 of balancing unit 700. Seen in A-direction shown in FIG. 9, more than two first inclined portions 932 may be formed in one portion of the width direction (w) of gear teeth 93 with respect to a central line (C2) across a width direction (w) of gear teeth 93 (see FIGS. 9 and 10(*b*) and (*c*)). For example, first inclined portion 932 having a preset slope may be formed in one portion in the width direction (w) of gear teeth 93 toward balancer housing cover 95. First inclined portion 932 may become narrower toward the central line (C2). Specifically, first inclined portion 932 may be formed in one portion in a width direction (w) of gear teeth 93 toward balancer housing cover 95.

First inclined portion 932 may be formed to make gear teeth 93 become narrower toward a width direction (w) end of gear teeth 93 toward balancer housing cover 95. For example, FIG. 10(*b*) illustrates front end 931 of gear teeth 93, seen in one direction. First inclined portion 932 may be formed in the width-direction end of front end portion 931 of gear teeth 93 projected from balancer housing base 94. More specifically, first inclined portion 932 may converge with respect to the central line (C2) as getting closer to lateral portion 933 of gear teeth 93.

FIGS. 9 and 10(*b*) illustrate that first inclined portion 932 is formed in a top of front end 931. First inclined portion 932 is formed by tilting both sides of the central line (C2) toward the central line (C2) with respect to the central line (C2) crossing front end 931 in a longitudinal direction.

Accordingly, when the user opens balancer housing cover 95 and arranges balancing unit 700 in balancer housing base 94, the lateral surface of driving gear 800 provided in balancing unit 700 is guided along first inclined portion 932 of gear teeth 93 for driving gear 800 to engage with gear teeth 93 smoothly.

When arranging balancing unit 700 in balancer housing base 94, the interference which could be generated between the lateral surface of driving gear 800 and lateral surface 933 of gear teeth 93 may be prevented or at least minimized by first inclined portion 932.

It is possible to form more than two first inclined portions 932 with respect to the central line (C2). In this instance, each of the first inclined portions is formed to have an inclination angle which becomes larger toward the width-direction (w) end of gear teeth 93.

The plurality of gear teeth 93 may be provided as the rack gear or ring gear and first inclined portion 932 may be formed in each of gear teeth 93. Accordingly, a sufficient space 995 may be secured between gear teeth 93 which could engage with driving gear 800.

Accordingly, when balancing unit 700 is arranged in balancer housing base 74 in B-direction shown in FIG. 9 after balancer housing cover 95 is open, the lateral surface (that is, the lateral surface of gear teeth 804 provided in driving gear 800) is guided along first inclined portion 932 of gear teeth 93 formed or installed in first inner circumferential surface 91 of balancer housing 90 to engage with gear teeth 93 easily. In other words, gear teeth 804 of driving gear 800 may be guided along first inclined portion 932 of gear teeth 93. Gear teeth 804 of driving gear 800 may be arranged in space 935 between each two of gear teeth 93 smoothly. First inclined portion 932 may function as a guide surface for guiding driving gear 800 of balancing unit 800.

Viewed from lateral surface 933 of gear teeth 93, a plane surface (P) may be formed in a lateral surface of gear teeth 93 and a second inclined portion 935 may be inclined toward the front end portion (T1) of gear teeth 93 from the end portion (T2) of the flat surface. In other words, viewed from B direction of FIG. 9, the plane surface (P) shown in FIG. 9(*c*) may be provided in the lateral surface of gear teeth 93. The plane surface (P) may be formed in a triangle shape. Second inclined surface 934 may be inclined from an apex (T2) of the plane surface (P) toward the tooth (T1). In other words, second inclined portion 934 may be inclined from the apex (T2) of the plane surface formed in the triangle shape toward the tooth (T1).

Second inclined portion 934 may be extended toward the tooth (T1) from the apex (T2) of the plane surface (P) toward the tooth (T1) of gear teeth 93.

For example, viewed from B direction of FIG. 9, the triangle-shaped plane surface (P) may be provided in at least predetermined portion of the lateral surface of gear teeth 93. A central line (C3) crossing gear teeth 93 in a height direction (h) may pass the top (or the apex) T2 of the plane surface (P). The central line (C3) crosses not only the apex (T2) of the plane surface (P) but also the tooth (T1) of gear teeth 93. At this time, second inclined portion 934 may be inclined toward the front end (T1) of gear teeth 93 from the end (T2) of the plane surface (P).

The plane surface (P) is inclined toward the front end (T1) of gear teeth 93 at a preset slope. Second inclined portion 934 has a larger slope than the plane surface (P). In other words, second inclined portion 934 extended from the end (T2) of the plane surface (P) and the plane surface (P) may be inclined toward the front end (T1) of gear teeth 93. At this time, the slope of the plane surface (P) is larger than the slope of second inclined surface 934. In other words, second inclined portion 934 may be inclined toward the front end (T1) of gear teeth 93 at a larger angle than the plane surface (P).

Referring to FIGS. 9 and 10(*c*), viewed from B direction of FIG. 9, a triangle-shaped plane surface (P) may be formed in the lateral surface of gear teeth 93. First inclined surface 932 may be inclined toward bottom 941 of balancer housing base 94 from two sides of the plane surface (P). Second inclined portion 934 may be formed toward the tooth (T1) of gear teeth 93 from the apex (T2) of the plane surface (P).

First inclined portion 932 may be defined by two inclined surfaces and each of the inclined surfaces may be defined by the plane surface (P) and second inclined portion 934.

The second inclined surface may be defined by a line extended toward the tooth (T1) of gear teeth 93 from apex (T2) of the triangle-shaped plane surface (P).

Accordingly, two inclined surfaces forming first inclined portion 932 may be spaced apart in both sides of the central line (C3) by the plane surface (P). The two inclined surfaces of first inclined portion 932 may be in contact with each other at second inclined portion 934 defined by lines. For example, first inclined portion 932 may be formed by two surfaces extended from a tooth bottom to the tooth edge. The two extended surfaces may be spaced apart in both sides of the plane surface (P). The two surfaces may surface-contact with each other at second inclined portion 934 extended toward the teeth edge (T1) from the apex (T2) of the plane surface (P).

When the user arranges balancing unit 700 in balancer housing base 94 to engage driving gear 800 with gear teeth 93 by opening balancer housing cover 95, the interference of the lateral surface of driving gear 800 provided in balancing unit 700 in lateral surface 933 of gear teeth 93 may be minimized Specifically, when balancing unit 700 is arranged in balancer housing 90, balancer housing cover 95 is open and balancing unit 700 may be installed toward balancer housing base 94 having the plurality of gear teeth 93. Balancing unit 700 has to be arranged in balancer housing 90 to engage driving gear 800 provided in balancing unit 700 with the plurality of gear teeth 93. At this time, it is likely for the lateral surface of driving gear 800 to interfere in the lateral surface of gear teeth 93. The interference between driving gear 800 and gear teeth 93 may be prevented or minimized by first inclined portion 932 and second inclined portion 934.

In other words, the user opens balancer housing cover 94 and installs balancing unit 700 in balancer housing cover 94 in B direction of FIG. 9. At this time, the interference between driving gear 800 provided in balancing unit 700 and the plurality of gear teeth 93 as rack gear or ring gear provided in balancer housing 90 may be prevented by first and second inclined portions 932 and 934. That is because first inclined portion 932 functions as a guiding surface for guiding driving gear 800. Second inclined portion 934 forming a boundary with first inclined portion 932 formed as two guiding surfaces may function as the guidance for guiding the engaging of driving gear 800 with gear teeth 93.

FIG. 11 is a graph illustrating variation of the voltages measured in the coil provided in an outer circumference of the tub.

Although not shown in the drawing, a first coil may be provided in tub 20 mentioned referring to FIGS. 4 through 8. The first coil may be provided with electricity from an external power supply source and some electric currents can flow in the first coil. Predetermined voltages may be applied to the first coil by the external power supply source.

A second coil may be provided in balancing unit 700. In FIG. 11, the first coil is Tx coil and the second coil is Rx coil.

For example, balancer housing 90 for balancing unit 700 may be installed in a front portion of drum 30. One or more second coils may be provided in a front portion of tub 20, corresponding to balancer housing 90. When balancing unit 700 movable within balancer housing 90 passes the second coil provided in tub 20, controller (not shown) provided in the washing apparatus may measure the voltage variation of the second coil which is generated by the electromagnetic induction and determine the position of balancing unit 700 based on the measured variation.

Specifically, one or more first coils (that is, Tx coil) may be provided in a predetermined portion of a front circumference of tub 20. For example, one or more first coils may be provided in a front circumference of tub 20, corresponding to the location of balancer housing 90 installed in drum 30. Such the first coil may be provided with electricity from an external power supply source (not shown). Typically, approximately 1 volt voltages may be applied to the first coil. The second coil (that is, Rx coil) not connected to the power supply source may be provided in balancing unit 700.

Balancing unit 700 may be rotated together with drum 30, in a state of getting secured in a preset position within balancer housing 90 or automatically (actively) movable within balancer housing 90, regardless of the rotation of drum 30. At this time, balancing unit 700 passes the portion of tub 20 where the first coil is located and the first coil is overlapped with the second coil provided in balancing unit 700. Then, electric currents are provided to the second coil by the magnetic field of the first coil. Accordingly, at the moment when the first coil provided in tub 20 is overlapped with the second coil provided in balancing unit 700, the voltage applied to the first coil may be higher than the predetermined voltages. For example, approximately 1 volt voltage is typically configured to be applied to the first coil. At the moment when the first and second coils are overlapped with each other, the voltage applied to the first coil can rise to approximately 3 volts.

At this time, the controller (not shown) may be implemented to always check the voltages applied to the first coil and determine the moment when the voltage applied to the first coil is higher than the predetermined voltage supplied by the power supply source. in other words, the controller may detect the moment when one or more first coils provided in a preset position of the circumference of tub 20 is overlapped with the second coil provided in balancing unit 700 and determine the location of balancing unit 700.

The position of balancing unit 700 may be detected or determined in an initial period of the drum rotation. For example, the controller may detect the position of balancing unit 700 based on the variation of the voltages applied to the first coil by the electromagnetic induction of the second coil, when the drum starts to be rotated (or in a preset time period after drum 30 starts to be rotated).

When drum 30 starts to be rotated for a washing, rinsing, or dry-spinning cycle, the controller may detect the position of balancing unit 700 according to the voltage variation of the first coil generated by the electromagnetic induction of the second coil. That is to move balancing unit 700 to a preset position for reducing eccentric rotation of drum 30 after recognizing the position of balancing unit 700 in the low speed rotation section of the drum. As mentioned above, balancing unit 700 may be secured in the preset position within balancer housing 90 in the low speed rotation section of drum 30 and balancing unit 700 is rotated together with drum 30. Hence, it happens that the first coil provided in the circumference of tub 20 is overlapped with the second coil provided in balancing unit 700. In other words, when balancing unit 700 is rotated together with drum 30, there is the moment when the first coil provided in the circumference of tub 20 and the second coil provided in balancing unit 700 pass each other. At this time, the controller senses variation of the voltages applied to the first coil (that is, a rise of voltage) and determines whether balancing unit 700 passes the portion where the first coil is provided. The controller provided in the washing apparatus may sense a difference between the voltages measured in the first coil and recognize the position of balancing unit 700.

Additionally, the controller recognizes the rotation speed of drum 30 and the moment when balancing unit 700 passes the portion of the first coil, only to determine an angular position of balancing unit 700 based on the rotation speed and the sensed moment.

In case vibration and noise are generated by the eccentric rotation caused by the asymmetric distribution of washing objects 1 in a specific portion of the drum and the rise of the rotation speed, the controller may figure out a current position of balancing unit 700 and move balancing unit 700 to the reverse portion from where washing objects 1 are asymmetrically distributed, so as to minimize the eccentric rotation and suppress the vibration and noise.

What is claimed is:

1. A washing apparatus comprising:

a tub provided in a cabinet;

a drum rotataby provided in the tub;

a balancer housing installed in a front or rear portion of the drum, the balancer housing comprising a first inner circumferential surface, and a second inner circumferential surface configured to face the first inner circumferential surface and have a larger diameter than a diameter of the first inner circumferential surface;

gear teeth formed along the first inner circumferential surface of the balancer housing; and a balancing unit comprising:

a body located in the space between the first inner circumferential surface and the second inner circumferential surface, a wheel rotatably mounted on the body and configured to contact with the second inner circumferential surface, a mass body mounted on the body and located in a region above the wheel, a cut out section formed in one end of the body and located in the space between the mass body and the wheel, a stopper provided in the body to contact with the first inner circumferential surface, a driving gear configured to be exposed outside the body to engage with the gear teeth, and a driving motor provided in the body to rotate the driving gear, wherein the balancing unit is movable within the balancer housing to reduce eccentricity of the drum when the drum rotates at a speed equal or higher than a predetermined speed.

2. The washing apparatus of claim 1, wherein one or more inclined portions are formed in each of the gear teeth to prevent interference between the driving gear and the gear teeth when the balancing unit is arranged in the balancer housing.

3. The washing apparatus of claim 2, wherein the balancer housing comprises:

a balancer housing base configured to be fixed to the drum and connect the first inner circumferential surface and the second inner circumferential surface; and a balancer housing cover, wherein the inclined portions are formed in a width direction portion of the gear teeth toward the balancer housing cover.

4. The washing apparatus of claim 3, wherein the inclined portions comprise a first inclined portion formed to make the gear teeth become narrower towards the balancer housing cover.

5. The washing apparatus of claim 4, wherein a plane surface is formed in a lateral surface of the gear teeth, and wherein the inclined portions further comprise a second inclined portion inclined from one end of the plane surface toward a front end of the gear teeth.

6. The washing apparatus of claim 4, wherein the first inclined portion converges to a central line across the gear teeth in a width direction closer to the end of the gear teeth.

7. The washing apparatus of claim 4, wherein the first inclined portion functions as a guiding surface for guiding the driving gear of the balancing unit, when the balancing unit is arranged in the balancer housing.

8. The washing apparatus of claim 5, wherein the plane surface has a preset slope toward the front end of the gear teeth, and wherein the second inclined portion has a larger slope toward the front end of the gear teeth than the slope of the plane surface.

9. The washing apparatus of claim 5, wherein the second inclined portion functions as a guide for guiding the driving gear of the balancing unit, when the balancing unit is arranged in the balancer housing.

10. The washing apparatus of claim 1, wherein the driving gear is a pinion gear, and the plurality of the gear teeth are rack gears or ring gears.

11. The washing apparatus of claim 1, wherein the gear teeth are integrally formed with the first inner circumferential surface of the balancer housing.

12. The washing apparatus of claim 1, wherein the gear teeth are fabricated as independent elements from the first inner circumferential surface.

13. The washing apparatus of claim 4, wherein a plurality of gear teeth are provided and the first inclined portion is formed in each of the gear teeth.

14. The washing apparatus of claim 5, wherein the plane surface is formed in a triangle shape, and wherein the second inclined portion is extended toward a tooth of the gear teeth from an apex of the plane surface toward the tooth of the gear teeth.

15. The washing apparatus of claim 1, further comprising an elastic member that is provided between the mass body and the wheel, so as to push the mass body to the first inner circumferential surface and to push the wheel to the second inner circumferential surface.

* * * * *